United States Patent [19]

Gorman

[11] 4,308,681

[45] Jan. 5, 1982

[54] PROGRESSIVE RATCHET RIFLING IN A FULL GAIN TWIST

[76] Inventor: Richard M. Gorman, 7915 Redstone Rd., Kingsville, Md. 21087

[21] Appl. No.: 130,383

[22] Filed: Mar. 14, 1980

[51] Int. Cl.[3] ..... F41C 21/00

[52] U.S. Cl. ..... 42/78

[58] Field of Search ..... 42/78

[56] References Cited

U.S. PATENT DOCUMENTS

| | | | |
|---|---|---|---|
| 16,377 | 1/1857 | Dimick | 42/78 |
| 300,515 | 6/1884 | Schneider | 42/78 |
| 329,303 | 10/1885 | Fosbery | 42/78 |
| 338,192 | 3/1886 | Rubin | 42/78 |
| 835,482 | 11/1906 | Vulpius | 42/78 |
| 868,938 | 10/1907 | Puff | 42/78 |
| 1,355,421 | 10/1920 | Pedersen | 42/78 |
| 1,355,422 | 10/1920 | Pedersen | 42/78 |
| 1,659,625 | 2/1928 | Cowan | 42/78 |
| 3,616,562 | 11/1971 | Burgsmuller | 42/78 |
| 4,126,955 | 11/1978 | Coffield | 42/78 |

*Primary Examiner*—Charles T. Jordan

*Attorney, Agent, or Firm*—John F. McClellan, Sr.

[57] ABSTRACT

Rifling in a gunbarrel accelerates in spiral from a relatively bore-parallel beginning and has a groove surface which in cross-section progressively rotates concurrently with the acceleration in spiral starting from a circumferential shape bounding rectangular lands to an incline merging with the top of a land one side of each groove and deepening the leading edge of a land on the other side of each groove.

9 Claims, 6 Drawing Figures

PROGRESSIVE RATCHET RIFLING IN A FULL GAIN TWIST

Figure 1:
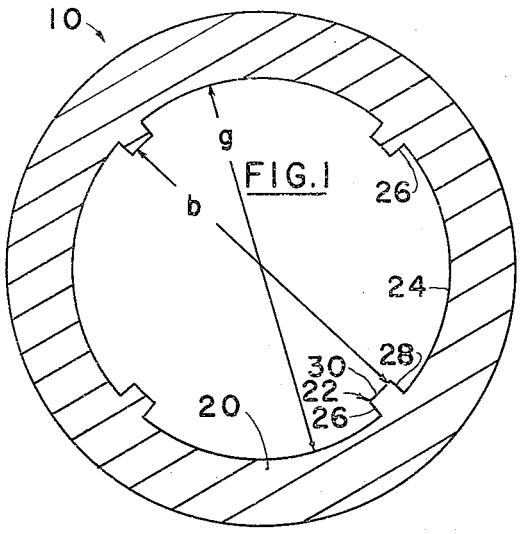

This invention relates generally to firearms and particularly to rifling in barrels of firearms.

A principal object of this invention is to provide a new system of rifling.

PRIOR ART EXAMPLES

In the prior art various disclosures have been made concerning rifling systems for projectiles fired through barrels, including those in the following U.S. patents:

No. 4,126,955 to G. G. Coffield, Jr., Nov. 28, 1978, discloses providing a progressively tighter fit for a projectile from the breech towards the muzzle in a rifled barrel;

No. 3,616,562 to K. Burgsmuller, Nov. 2, 1971, shows rifling with a cross-sectional configuration in which there are three lands inclined so that one side of each merges into the root of the next adjacent land;

No. 1,659,625 to A. A. Cowan, Feb. 21, 1928, discloses providing a smoothbore space 17 to receive the projectile, which when fired forwardly engages the rifling in a rifled barrel;

No. 1,355,422 to J. D. Pedersen, Oct. 12, 1920, discloses providing a barrel with different size and shape rifling in a zone toward the breech from that in a zone toward the muzzle; "gain" rifling is mentioned;

No. 1,355,421 to J. D. Pedersen, Oct. 12, 1920, an "unrifled projectile seat" at the breech end of a barrel having larger ribs towards the front than at the back;

No. 868,938 to C. Puff, Oct. 22, 1907, teaches having grooves deeper at one portion of the barrel than another;

No. 338,192 to E. Rubin, Mar. 16, 1886, discloses a rifle barrel having grooves vanishing at the breech end into a smooth portion;

No. 300,515 to A. Schneider, June 17, 1884, discloses rifling which is nearly parallel with the bore at the breech (which recurves opposite the spiral intermediate the length) and which has an increasing spiral at the muzzle;

No. 16,377 to H. E. Dimick, Jan. 13, 1857, discloses a barrel which has slight twist in the rifling to start but in which the rifling has an increasing spiral toward the muzzle.

Since the earliest developments more than five hundred years ago rifling systems have been evolving and improving. However, perfection has not yet been attained in efficiency, range and accuracy.

BRIEF DESCRIPTION OF THE INVENTION

Further objects of the invention are to provide a new system of rifling as described, which produces projectile accuracy and range not before attainable; to provide a system which can be used throughout the whole length of a barrel or a partial length; to provide a system in which from the beginning towards the muzzle there is a change in lead of the rifling, a change in land/-groove proportion, a change in land and groove inclination and shape, and a change in groove diameter, all coacting to improve the rifling and results.

In brief summary given as cursory description only and not as limitation, the invention includes a rifling system in which the rifling as it leads toward the muzzle begins with relatively shallow, narrow, generally rectangular-shape lands in cross-section, and longitudinally relatively parallel with the bore, and progresses in continuous transition and accelerating spiral through intermediate positions in which each groove, in cross-section, inclines deeper at the leading edge of one adjacent land and shallower at the other adjacent land until at the muzzle-end of the rifling each land has in cross-section only one lateral face, the leading edge, and in cross-section inclines in an outwardly circumferential direction to a terminus at root of the next land.

Figure 4:
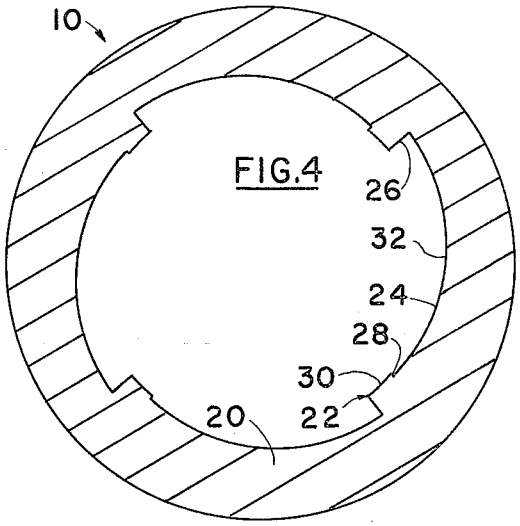
Figure 5:
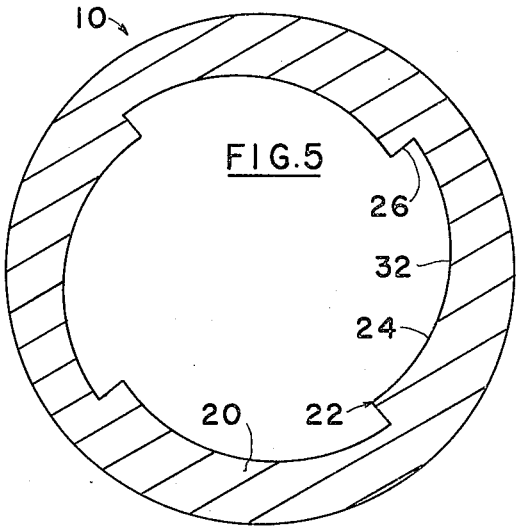
Figure 6:
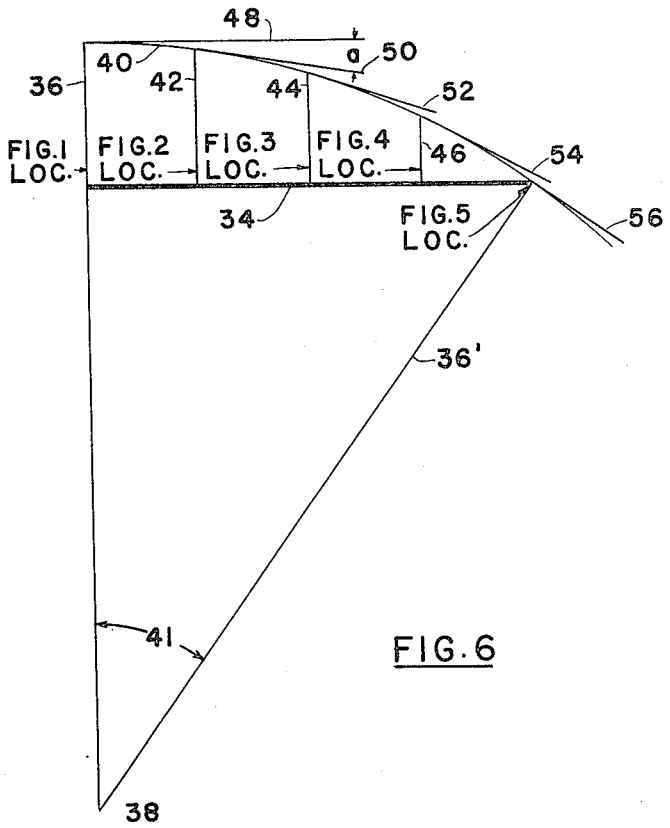

These and other objects and advantages of the invention will become more readily apparent on examination of the following description, including the drawings in which:

FIGS. 1 through 5 are successive-location diagrams as viewed from the breech towards the muzzle, of sections of rifling with spiral omitted for exposition; and FIG. 6 is an exaggerated diagram of rifling spiral acceleration.

In the following sectional Figures spiralling is exaggerated for exposition in the sense that as noted these Figures omit spiralling, for purposes of making comparison easier.

FIG. 1 shows the invention 10 in sectional detail of a barrel 20 having surfaces defining lands 22 and grooves 24. Bore diameter is indicated at b and groove diameter at g.

Each land has a leading edge 26, customarily the edge imparting spin to a projectile and it may be generally radial, and a trailing edge 28 of similar configuration and depth; the land top 30 may be circumferentially arcuate.

Each groove is arcuate and, as shown, in the beginning portion of the rifling circumferentially aligned.

In addition the rifling is also longitudinally aligned substantially parallel with the bore in the beginning portion.

Groove depth may be about 0.0035 inch (0.1 mm) in a thirty calibre barrel.

Any conventional number of lands and grooves may be used, and these preferably are on uniform circumferential spacings.

The lands may conventionally begin near the chamber of the piece. In any event being narrow and relatively straight at the breech and they permit the projectile to accelerate rapidly and with less projectile deformity.

Figure 2:
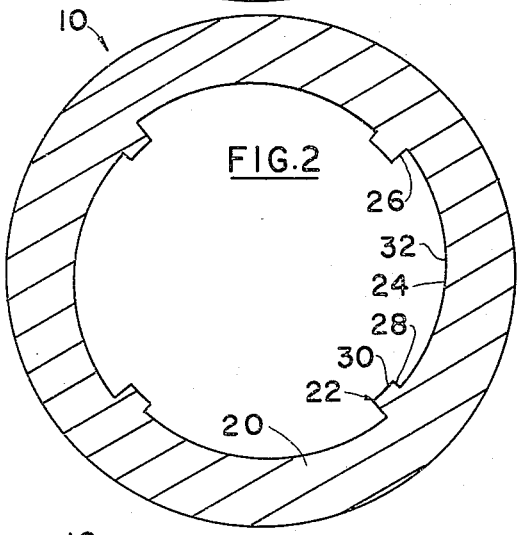

FIG. 2 diagrams a successive location along the barrel. In accordance with this invention, in proportion with distance along the rifling the arcuate surface defining the groove 24 cross-sectionally rotates as a contour, relative to the bore diameter. Point of rotation 32 may be midway between the ends of the groove, but preferably should be closer to the deepening side. For example, in 30 calibre, 6 land/groove rifling it may be about 0.015 inch (0.037 mm) closer.

The deepening side is bounded by the leading edge 26 of an adjacent land on one side, and the shallowing side by the trailing edge 28 of an adjacent land on the other side.

Effect of off-centerness of the pivot point is to assure good sealing regardless of the deepening by constricting the bore progressively by diminishing the cross-sectional area.

Figure 3:
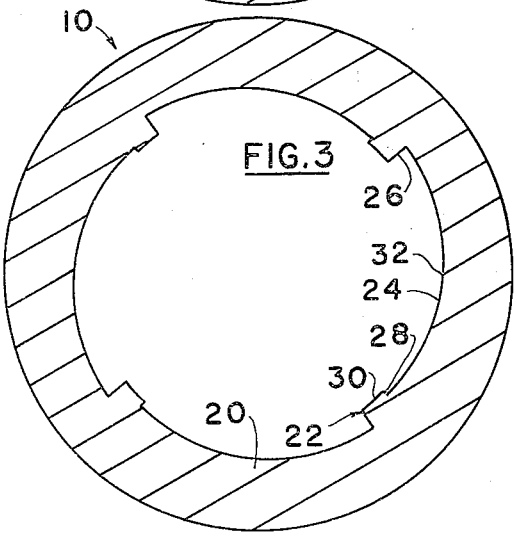

FIGS. 3 and 4 show at continuing locations stages of the rotation of the surface of the groove, which will gradually and progressively lead to merger of the top 30 and the trailing edge 28 with the rotated contour of the groove 24.

FIG. 5 shows the configuration at the end. By merger with the rising end of the rotated groove 24 each land 22 has become generally triangular in cross-section (ratchet rifling) and has the depth of the leading edge 26 doubled approximately.

Effect of off-centerness of the groove pivot point was discussed above. The effect of pivoting the groove is provision of a relatively shallow land at the breech end of the rifling which offers less resistance to the projectile. The increase in depth of the leading edge affords an increasing grip on the projectile coincident with increasing projectile resistance to spin as projectile velocity progressively increases along the acceleration curve.

FIG. 6 exaggeratedly diagrams points on the spiral rifling acceleration curve, the acceleration being according to this invention concurrent with the groove rotation described.

The rifled bore is diagrammed as a half-chord 34 (heavy line) perpendicular to the "Y" axis 36 which is a radius extending from point 38 below the chord and describing an arc 40. Length of the radius is chosen as a function of desired rifling helix or spiral acceleration curve, the shorter the radius the sharper the acceleration curve, all other things remaining constant.

At uniform distances along the chord 34 respective lines 42, 44, 46 are drawn perpendicular to it and extending to the arc 40. The radius and these lines represent the locations of the views of the respective Figures. The angles (as shown) between line 34 and the respective tangents 48, 50, 52, 54, 56 to the arc 40 at the intersection of the radius and of each of these lines represent the spiral or helix angle or angles of twist of the rifling at that point. Similarly the angle between the radius 36 and another radius (36' shown) through one of the points of tangency represents the local helix angle of the rifling, as indicated at 41.

The effect of this curve is to provide a uniform increase of spiral with distance along the barrel.

An overall effect of this invention is to eliminate the abruptness of projectile engagement and spin by the rifling. Two distinct advantages are provided. One is less projectile distortion and therefore greater accuracy. A second is lower initial chamber pressure permitting increased charges to be used, either by change in quantity or change in type, and therefore providing greater range. Net result is the combination of better accuracy and range, and less recoil.

It is to be understood that the invention can be practiced apart from the concept of unitary barrel. The length of the barrel in which it is embodied can be an add-on or splice-in length of the barrel, on the end or intermediate the length, such separate part adapters being joined by conventional means such as screw threads as in compensators.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a barrel having rifling running from beginning to end of a portion of the bore and including surfaces defining lands, and grooves, the lands having respective leading edges for guiding projectiles and trailing edges and tops the improvement comprising in combination: at the beginning each land having in cross-section a relatively narrow and shallow rectangular shape with the leading and trailing edges relatively equal in depth, said rifling being at the beginning relatively parallel with the bore and running forwardly therefrom in an accelerating spiral; and concurrently with said forward running each groove surface rotating in a direction increasing the depth of the leading edge of a land adjacent to a first side thereof and decreasing the depth of the trailing edge of a land adjacent to a second side thereof until at said end the trailing edge and top of each land are merged with an adjacent rotated groove contour.

2. In a barrel as recited in claim 1, said increased depth being, at said end, generally twice the depth at said beginning.

3. In a barrel as recited in claim 2, said rotating being about a point, said point being closer to the leading edge than the trailing edge.

4. In a barrel as recited in claim 1, the top of each land being generally arcuate in shape in cross-section.

5. In a barrel as recited in claim 1, said groove surface being generally circumferentially arcuate in shape in cross-section at said beginning.

6. In a barrel as recited in claim 1, said groove surface rotating being in predetermined proportion to said spiral acceleration.

7. In a barrel as recited in claim 6, said leading edge being generally radial to said bore in cross-section.

8. In a barrel as recited in claim 6, said acceleration spiral having respective angles at successive stations along said barrel according to respective angles between the chord of an arc and tangents to said arc at points of intersection therewith of respectively successive lines perpendicular to said chord at points uniformly spaced along said chord corresponding to said respective stations.

9. In a barrel as recited in claim 1, said portion of the barrel being a separate part of the barrel.

* * * * *